US006136264A

United States Patent [19]

Wigchert

[11] Patent Number: 6,136,264

[45] Date of Patent: Oct. 24, 2000

[54] MELTING APPARATUS AND METHOD FOR MELTING METAL

[75] Inventor: Albertus Johannes Maria Wigchert, Santpoort-Noord, Netherlands

[73] Assignee: Hoogovens Aluminium N.V., Duffel, Belgium

[21] Appl. No.: 09/269,549

[22] PCT Filed: Oct. 9, 1997

[86] PCT No.: PCT/EP97/05585

§ 371 Date: Jun. 11, 1999

§ 102(e) Date: Jun. 11, 1999

[87] PCT Pub. No.: WO98/15792

PCT Pub. Date: Apr. 16, 1998

[30] Foreign Application Priority Data

Oct. 9, 1996 [EP] European Pat. Off. ..... 96202800

[51] Int. Cl.[7] ..... F27B 3/04; C22B 21/00

[52] U.S. Cl. ..... 266/235; 266/216; 266/901

[58] Field of Search ..... 266/216, 235, 266/237, 901, 200

[56] References Cited

U.S. PATENT DOCUMENTS

| | | | |
|---|---|---|---|
| 3,276,758 | 10/1966 | Baker . | |
| 3,984,234 | 10/1976 | Claxton et al. | 266/901 |
| 4,060,408 | 11/1977 | Kuhn . | |
| 4,128,415 | 12/1978 | van Linden et al. | 266/901 |
| 4,491,474 | 1/1985 | Ormesher . | |

FOREIGN PATENT DOCUMENTS

| | | |
|---|---|---|
| 856271 | 6/1940 | France . |
| 2332510 | 6/1977 | France . |
| 8229700 | 7/1986 | Germany . |
| 778267 | 5/1988 | U.S.S.R. . |

*Primary Examiner*—Scott Kastler
*Attorney, Agent, or Firm*—Stevens, Davis, Miller & Mosher, L.L.P.

[57] ABSTRACT

Melting apparatus for melting a metal, such as aluminium, comprising a melting chamber, a burner chamber and a passage which extends between the melting chamber and the burner chamber and which has an inlet opening on the melting-chamber side and an outlet opening on the burner chamber side for allowing molten metal to pass from the melting chamber to the burner chamber, circulation means being suitable for transferring molten metal from a first or suction connection to the burner chamber to a second or pressure connection to the melting chamber. According to the invention, the residual bath when changing the metal composition ins minimized and productivity maximized.

22 Claims, 2 Drawing Sheets

MELTING APPARATUS AND METHOD FOR MELTING METAL

The invention relates to a melting apparatus for melting a metal, such as aluminium, comprising a melting chamber, a burner chamber and a passage which extends between the melting chamber and the burner chamber and which has an inlet opening on the melting-chamber side and an outlet opening on the burner-chamber side for allowing molten metal to pass from the melting chamber to the burner chamber, and further comprising circulation means which are suitable for transferring molten metal to a second or pressure connection of the melting chamber from a first or suction connection of the burner chamber. Also the invention relates to a method for melting metal.

Such a melting apparatus is disclosed in U.S. Pat. No. 4,491,474.

Metal scrap to be melted is introduced into the melting chamber via a closable charging opening in a wall of the melting chamber.

In this operation, the metal scrap may first be placed on a loading incline adjoining the base of the furnace vessel in order to preheat it, after which it is pushed into the bath by metal scrap introduced later. The metal scrap can also be introduced directly into the bath.

As a consequence of the high temperatures in the melting chamber, some of the organic and combustible materials entrained with the metal scrap or adhering to it pyrolyses or, if oxygen is present, burns. Other impurities and oxides finish up in a slag layer on the molten metal, but cannot reach the burner chamber as a result of the presence of the partition.

In the burner chamber, burners are fitted to heat the molten metal. The melting capacity of the melting apparatus increases with increasing surface area of the bath in view of the transfer of heat generated by the burners to the metal. Burner offgases can be removed directly to the outside. It is also possible to pass the offgases through the melting chamber in order to preheat the metal scrap.

As the result of convection, molten metal flows within the melting chamber and within the burner chamber and between these two chambers. Molten metal which flows from the burner chamber to the melting chamber gives off heat there to the part of the bath in the melting chamber and to metal scrap still to be melted and flows back to the burner chamber.

The metal to be melted, such as aluminium, for use in such a furnace apparatus is generally metal scrap originating as residues from production processes, but it may also be metal collected from another source. The chemical composition of the metal is generally only known approximately. For the purpose of processing the metal removed from the melting apparatus further, its chemical composition should in general be between given tolerance limits. Corrections to the chemical composition, obtained after melting, of the molten metal are possible as a result of diluting the metal which forms the main constituent in the case of unduly high concentrations of alloy elements or impurities, or by adding an alloy element if its concentration in the molten metal is unduly low.

The method described above can be performed as long as molten metal of a particular composition or family of compositions has to be made and metal scrap of a particular composition or family of compositions is therefore used.

A problem with the known melting apparatus and the method of operating it arises if the chemical composition of the molten metal has to be altered, for example in the event of an alloy change. From the description of the method, it follows that the bath of molten metal in the melting apparatus functions as heat-transfer medium for transferring the heat originating from the burners or another heat source in the burner chamber to the metal scrap to be melted. During the changeover from a first chemical composition to a second chemical composition of the molten metal, it is therefore customary to empty the melting apparatus until a bath of a certain size, also referred to as residual bath, of the first composition remains. Then metal of a flushing composition or of the second composition is added to the residual bath. In this operation, it is not always possible to obtain, with the metal added, a bath whose chemical composition is within given limits. As a result of emptying the melting apparatus again and filling it again with metal of a flushing composition or of the second composition, the influence of the first composition on the composition of the bath can be considerably reduced. As a consequence of the undesired or incorrect composition, the bath contents removed will have no direct application. After it has solidified, the metal of incorrect composition can be stored and remelted at a later time. In this operation, a certain amount of metal will be lost as a result of oxidation.

The extent of dilution necessary to arrive at the desired composition of the bath plays a part in the determination of the size of the residual bath. In this process, metal of an undesired, incorrect composition may be produced. A chosen residual bath having a volume of 20% of the nominal volume of the molten bath is conventional as a compromise.

The object of the invention is to provide a melting apparatus for melting metal with which it is possible to change the chemical composition of the molten metal with a smaller residual bath than hitherto customary and possible for production engineering reasons and with which other advantages are also achievable.

These objects are achieved with the melting apparatus which, apart from having circulation means which are suitable for transferring molten metal to a second or pressure connection of the melting chamber from a first or suction connection of the burner chamber, according to the invention is characterised in that the base of the melting chamber is inclined towards the inlet opening of the passage by a melting chamber gradient, in that the base of the burner chamber is inclined with a burner-chamber gradient towards the suction connection and in that it is provided with distribution means in order to spread the liquid metal emerging from the outflow opening over the base of the burner chamber for the purpose of increasing the surface area of said base covered by liquid metal in a situation in which the level of the liquid level in the melting apparatus is lower than the outflow opening.

It can be advantageous if the second or pressure connection is situated higher than the first suction connection in view of the mutual position of the bases of the burner chamber and the melting chamber, that is to say also if the base of the melting chamber is higher than that of the burner chamber or vice versa.

With the circulation means, molten metal can be transferred from the burner chamber to the melting chamber, where it comes into contact with metal scrap to be melted and will cause the latter to melt, at least partly. The molten metal then flows towards the passage and via the passage back to the burner chamber, where it is reheated and is taken up again by the circulation means for renewed circulation. In the melting chamber, a certain amount of metal can be melted for each circulation of the molten metal as just described and/or therefore per unit time. The time used for a circulation of the molten metal from melting chamber via burner chamber back to melting chamber is appreciably shortened as a result of the forced circulation. As a result, more heat can be fed to the molten metal circulating between the chambers per unit time, and consequently more metal can be melted per unit time than in the known melting apparatus.

It is possible with the invention to reduce the residual bath appreciably, with the result that a greater changeover in the chemical composition of the bath is possible without a metal of incorrect composition being produced. Given a potential, large changeover in the chemical composition of the bath, the smaller residual bath results in an appreciably lower risk of metal of an incorrect composition being produced, as a result of which the risk in casting metal in solid form decreases proportionately.

A preferred embodiment of the melting apparatus according to the invention is characterised in that the circulation means comprise an electromagnetic pump. Such a pump provides the advantage of a large working head, as a result of which a great degree of freedom is achieved in the construction of the melting apparatus. Another advantage is that the electromagnetic pump has few or no movable parts and is consequently low in maintenance and not susceptible to malfunction.

Particular advantages are achieved because the base of the melting chamber is inclined with a melting-chamber gradient towards the inlet opening of the passage, the melting-chamber gradient preferably being inclined from the pressure connection towards the inlet opening of the passage. Molten metal which is introduced into the melting chamber by the circulation means via the pressure connection is able to leave the melting chamber through the passage to the burner chamber together with metal additionally melted from the solid state in the melting chamber. This embodiment consequently contributes to the possibility of keeping the residual bath in the melting apparatus low.

Also particular advantages are achieved because the base of the burner chamber is inclined with a burner-chamber gradient towards the suction connection, the burner-chamber gradient preferably being inclined towards the suction connection from the outlet opening of the passage. It is possible with this embodiment to empty the burner chamber substantially and therefore retain a smaller residual bath. In addition, this embodiment achieves the result that, as a result of the intervention of the circulation means, molten metal continues to circulate even with a small residual bath, as a result of which heat can be absorbed per unit time in the burner chamber and transferred to solid metal to be melted in the melting chamber.

The inclined base of the burner chamber contributes, just as is the case for the inclined base of the melting chamber, to a rapid flow of molten metal through the burner chamber and therefore to a large capacity for absorbing heat per unit time and consequently to the melting capacity, even if the residual bath is chosen as small or in the case of a small bath volume.

A particularly compact construction of the melting apparatus according to the invention is possible in the case of an embodiment which is characterised in that the direction in which the melting-chamber gradient is inclined differs essentially from the direction in which the burner-chamber gradient is inclined and, more particularly, in that the direction in which the melting-chamber gradient is inclined is essentially opposite to the direction in which the burner-chamber gradient is inclined. The circulation means permit a greater freedom in the construction of the furnace apparatus because the operation is no longer dependent on just convection within the bath of molten metal. Within the possibilities of the chosen circulation means, there is freedom of choice in the mutual positioning of the suction connection and the pressure connection and, given an inclined base of the melting chamber and/or burner chamber, also in the direction in which the base of the one chamber is inclined with respect to the direction in which the base of the other chamber is inclined. In this connection, a particularly compact construction can be achieved if both directions extend essentially in an intersecting and opposite manner. Pipes and components between suction connection and pressure connection, including also the circulation means, can then be positioned in the immediate vicinity of one another. Pipes which connect the suction connection and the pressure connection to the circulation means can be short, as a result of which little heat loss occurs and the flow resistance can be minimised. As a result of the choice of opposite directions of inclination, the burner chamber and the melting chamber can be constructed next to one another, resulting in low energy losses due to the partition. Preferably, the passage extends in this case from a position near the lowest region of the base of the melting chamber to a position near the highest region of the base of the melting chamber. Preferably, the passage extends only over a limited part of the partition near said regions. If circulation means are used, there is little or no need for a large passage because there is no longer dependence on free convection.

During operation, liquid metal in the melting chamber will collect at or near the lowest point as a consequence of the angle of inclination of its base. If the average bath level in the burner chamber is lower under these circumstances (allowing for the amount of metal in circulation) than the level of the base of the melting chamber near the passage, all the liquid metal will flow back out of the melting chamber via the passage into the burner chamber.

If the bath level in the burner chamber is higher than the level of the base of the melting chamber (at the position of the inlet of the passage), the liquid metal still flows towards the lowest point in the melting chamber. As a consequence of the circulation means used, all the liquid metal will be absorbed in the circuit.

Yet another advantage of this embodiment of the melting chamber is that, in a situation without forced metal circulation, a contribution is therefore effectively made to the attempt to minimise the residual bath under all circumstances, that is to say regardless of the height of the bath in the burner chamber and possibly even in the melting chamber.

Another advantage of this embodiment of the melting chamber is that, in a situation with forced metal circulation, the flow of metal into the melting chamber from the pressure connection to the level of the residual bath is accelerated. As a result, a contribution is made to the attempt to minimise the residual bath even in this situation.

Another embodiment of the melting apparatus which, according to the invention, contributes to a large melting capacity with a small residual bath is characterised in that the melting apparatus is provided with a transport channel which is suitable for conveying molten metal between the pressure connection and the inlet opening of the passage at least in a situation in which the base of the melting chamber is not completely covered with liquid metal. Molten metal which enters the melting chamber through the pressure connection can be conveyed through the transport channel, it being ensured that solid metal to be melted is also conveyed in the transport channel, for example by means of a suitable hopper chute.

In the situation of a low level of the bath, the solid metal in the transport channel is in intimate contact with all, or with a large part, of the molten metal fed via the pressure connection, as a result of which the chance of solidification of the solid metal, as in the situation involving a small residual bath, is reduced and the melting capacity is increased in said situation. Preferably, the transport channel is an open channel. A simple and expedient embodiment is characterised in that the transport channel is bounded by the base of the melting chamber and a wall of the melting chamber in which the inlet opening is situated, which base and wall enclose an acute angle. Such a transport channel can easily be made by giving the base of the burner chamber a gradient, as a result of which said base is inclined in the direction of the wall, preferably the partition between the two chambers, the transport channel therefore being hounded by a part of the base of the melting chamber and a part, adjacent thereto, of the partition.

A further increase in the melting capacity is achieved because of the presence of distribution means in order to spread the liquid metal emerging from the outflow opening over the base of the burner chamber for the purpose of increasing the surface area of said base covered by the liquid metal in a situation in which the level of liquid metal in the melting apparatus is lower than the outflow opening.

Generally, the melting capacity is proportional to the bath surface area irradiated by the heat sources, such as burners. As has already been stated above, as a result of the discharge gradient in the melting chamber and the slope in the burner chamber, the bath surface area decreases with decreasing bath content. As a result of spreading the molten metal introduced into the burner chamber or present therein, such as the residual bath, over as large a part as possible of the base of the burner chamber, a large irradiated surface area is obtained even in the case of a small residual bath.

According to the invention it is now also possible to more effectively retain the dross in the melting chamber which gives the additional advantage that the heat transfer to the molten metal in the burner chamber is maximised.

The invention is also embodied in a method for melting a metal such as aluminium, in which molten metal is removed from a burner chamber and transported by means situated outside the burner chamber and the melting chamber to a melting chamber, the melting chamber and the burner chamber being hydraulically coupled to one another and, in which an apparatus according to the invention is used.

BRIEF DESCRIPTION OF THE DRAWINGS

The invention will be explained below by reference to the drawing of a non-restrictive embodiment of a melting apparatus according to the invention. In the drawing:

In the figures, corresponding elements or elements having identical functions have corresponding reference numerals.

In FIG. 1, 1 is a melting apparatus in which the invention is embodied. The melting apparatus comprises a melting chamber 2 and a burner chamber 3, which are separated from one another by a partition 4. The melting apparatus comprises on its outside a heat-insulating and heat-resistant outside wall 5. Partition 4 is also heat-resistant, but, for a better heat transfer between melting chamber and burner chamber, can have a high thermal conductivity. The partition 4 extends from the ceiling 6 (see FIG. 2) to both the base 7 of the melting chamber and the base 8 of the burner chamber and is provided with a localised passage 9. Preferably, means are fitted in or near the passage for retaining or removing slag produced in the melting chamber. Passage 9 has an inlet opening 10 on the melting-chamber side and an outlet opening 11 on the burner-chamber side. The base 7 of the melting chamber is inclined in the direction of arrow 12 from the second or pressure connection 13 to the inlet opening 10. Base 7 is also inclined from side wall 14, which forms part of the wall 5, towards the partition 4 in the direction of arrow 15. Partition 4 and base 7 enclose an acute angle a (see FIG. 2). Side wall 14 is provided with a charging opening 16 behind which a discharge chute 17 is positioned for the introduction via the latter of metal to be melted. Burner chamber 3 has a base 8 which is inclined in the direction indicated by the arrow 18 from the inlet opening 11 in the direction of the first suction connection 19.

Figure 1:
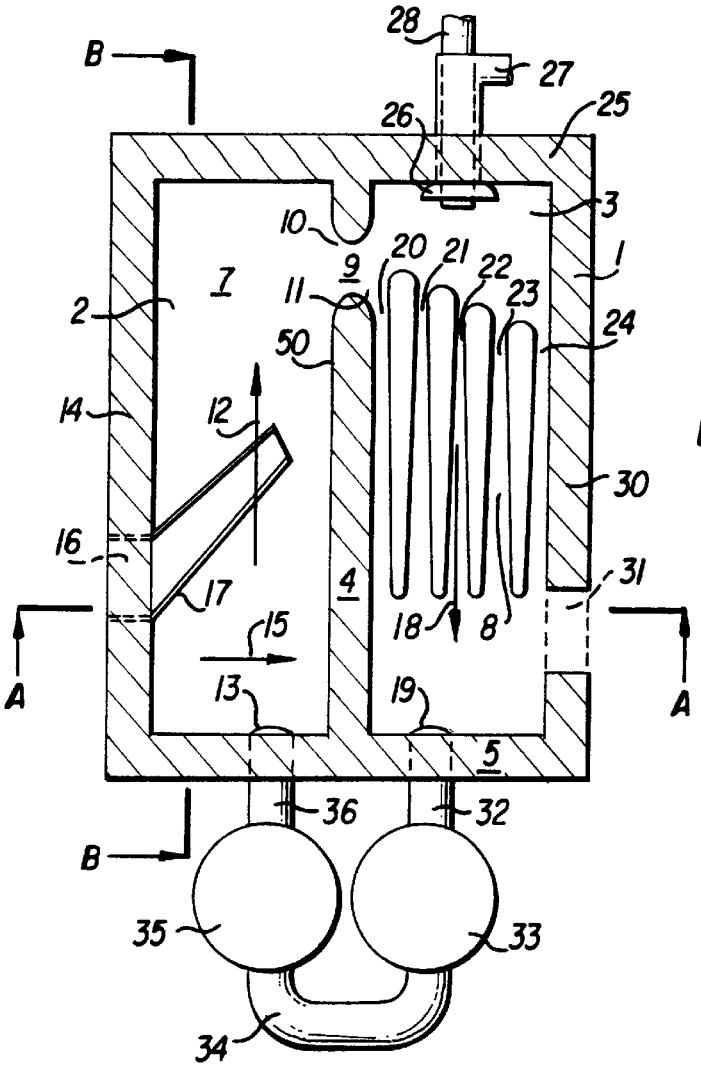
FIG. 1 shows a diagrammatic plan view of a cross section of a melting apparatus according to the invention.

In the rear wall 25, which forms part of the outside wall 5, a burner 26 is positioned which is provided with connecting pipes 27 and 28 for connection to an oxygen source and fuel source, which is not shown. Flue gases which are produced in the burner by combustion of the fuel with oxygen, can be removed via flue-gas outlet 29 (see FIG. 2). In side wall 30, which is part of outside wall 5, a closable tapping opening 31 is fitted via which molten metal can be removed from the melting apparatus.

Near the outflow opening 11, base 8 is provided with distribution means in the form of a number of distribution channels 20, 21, 22, 23, 24 in order to spread liquid metal, which flows into the burner chamber through the passage, over as large a part as possible of base 8.

Connected to suction connection 19 by means of a suction pipe 32 is a pump 33, preferably an electromagnetic pump. The outlet of the pump 33 is connected by means of a coupling pipe 34 to a so-called loading cistern 35, which is connected by means of pipe 36 to the pressure connection 13. The loading cistern can be included in order to melt finely divided solid particles rapidly. If desired, a slag-removal vessel 40, which is not shown in greater detail, can also be included in pipe 36 to remove slag floating on the liquid metal. Liquid metal can also be removed from the loading cistern or from the slag-removal vessel. With the circulation means, a greater freedom is also obtained in the positioning of the loading cistern and the slag-removal vessel, in particular, as regards the level of the bases thereof with regard to liquid metal remaining behind.

Figure 2:
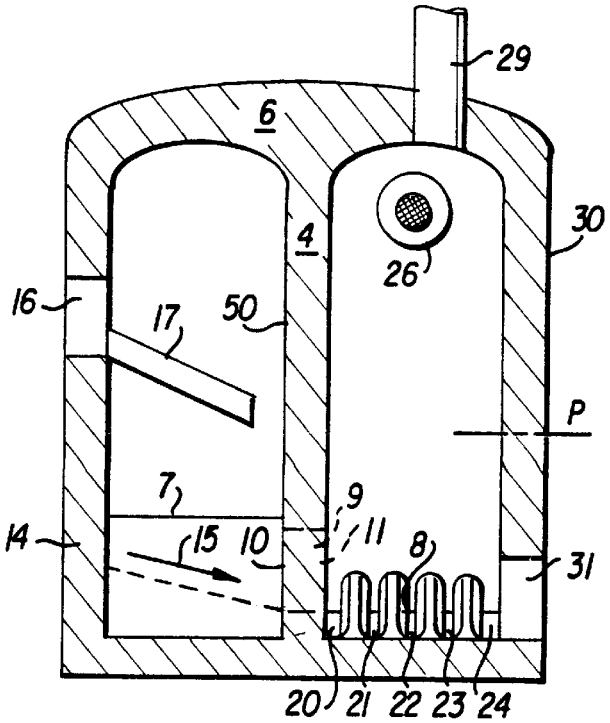
FIG. 2 shows a diagrammatic front view of a section along the line AA in FIG. 1.

FIG. 2 diagrammatically shows a front view of a section along the line AA in FIG. 1. Arrow 15 indicates that base 7 is inclined in the direction of the arrow from side wall 14 towards partition 4.

Figure 3:
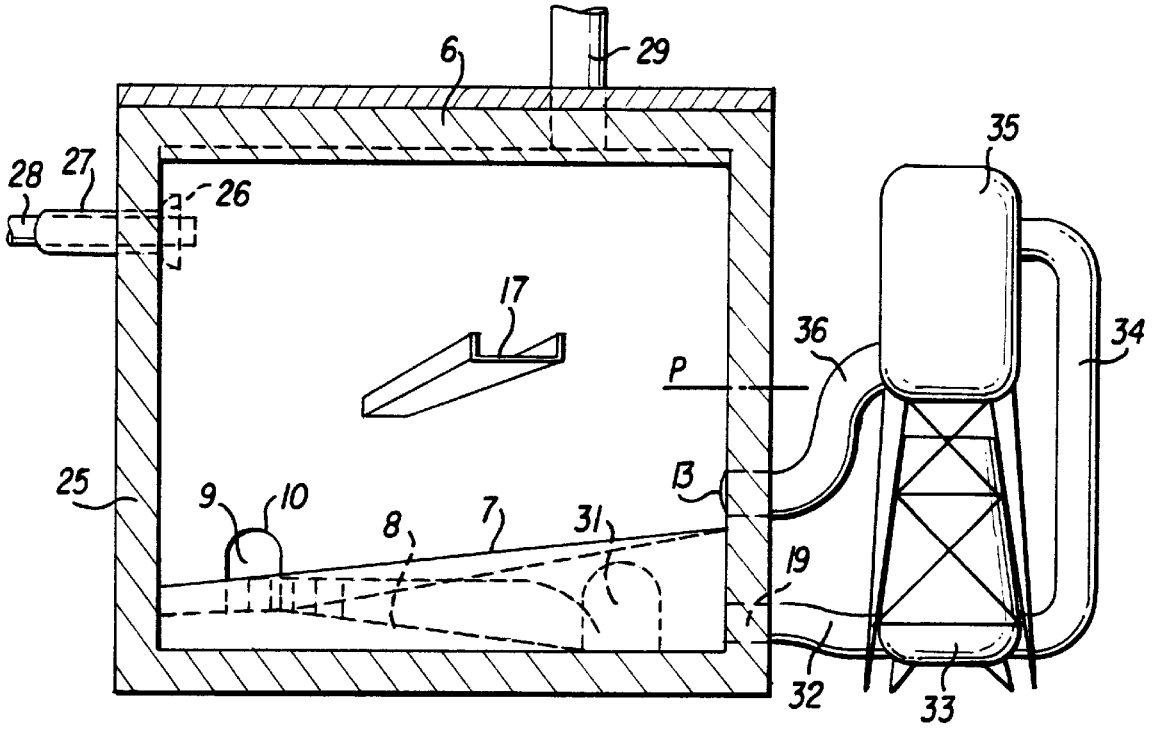
FIG. 3 shows a diagrammatic side view of a section along the line BB in FIG. 1.

FIG. 3 shows a diagrammatic side view of a section along the line BB in FIG. 1. The figure reveals the opposite and intersecting course of the two bases 7 and 8, a passage 9 being fitted between a low region, and preferably the lowest region, of base 7 and a high region, and preferably the highest region, of base 8.

The working and the operation of the melting apparatus proceed as follows:

During normal use, the melting apparatus is charged with liquid metal, such as liquid aluminium, to the level shown by the indication line P.

In changing over from the one, first alloy or composition of the metal to be melted to another, second alloy or composition to be melted, molten first alloy is removed via tapping opening 31 until a residual bath of desired size is left. This size can be chosen to be very small, in principle it is sufficient that the suction opening 19 remains adequately covered and that sufficient molten material is present in the circulation part, comprising the elements 32, 33, 34, 35, 36 and slag-removal vessel 40, which is not shown, for a good operation thereof. It is pointed out in this connection that the loading cistern 35 and the slag-removal vessel 40 are optional. The melting apparatus itself can be virtually completely free of molten metal of the first alloy. The liquid metal which forms the residual bath is passed through suction opening 19 via pipe 32 to pump 33 and is after passing through a slag-removal vessel 40, to pressure connection 13. Via pressure connection 13, the liquid metal finishes up on base 7 and, on the one hand, flows down as a consequence of the gradient indicated by arrow 12 and, on the other hand, as a consequence of the gradient indicated by arrow 15 in the direction of the partition 4. As a consequence of the two gradients mentioned, the molten metal therefore flows initially essentially through a transport channel 50 which is bounded by parts, adjoining at the angle a, of the partition 4 and the base 7.

Solid metal is introduced into the liquid metal flowing through the transport channel 50 through charging opening 16 via hopper chute 17, as a result of which at least part of the solid metal melts, which part flows along with the liquid metal introduced through the pressure connection 13 to and through passage 9. The molten metal, now cooled, is spread over the base 8 of the burner chamber by the distribution means formed by the distribution channels 20–24. In the burner chamber, fuel, supplied via pipe 28, is burnt with oxygen, supplied via pipe 27, by burner 26. A relatively small amount of molten metal has a large irradiatable surface area as a result of having been spread over a large part of the base of the burner chamber and can consequently absorb much of the heat generated by the burner on its downward path over the base 8. The molten metal heated in this way ends up at suction opening 19 and is circulated in the melting apparatus in the manner described. The volume of molten metal increases continuously as a result of adding solid metal which is melted in the melting chamber. The molten metal is a mixture of the first alloy and the second alloy. If desired, to accelerate the dilution of the first alloy with the second alloy, the melting apparatus can be emptied again in the meantime down to a desired residual bath, after which solid metal of the second alloy can be introduced again into the melting chamber. The metal removed has an incorrect composition and is stored in order to be melted again or processed at a suitable point later in time. As a result of melting more metal than is introduced, the level of the molten metal in the bath rises, as a result of which base 8 is completely covered, passage 9 has a full flow and, finally, base 7 is covered. The level can be increased further to a desired height, such as the nominal height indicated by P.

The two bases 7 and 8 each have a drop between pressure connection and passage or passage and suction connection, respectively, of approximately 10 to 15 cm over a distance of approximately 6 m.

Where a passage has been mentioned above, it will be clear to the person skilled in the art that this is also to be understood as meaning an opening in a wall, such as a partition. In the above, reference is made to a chamber as burner chamber. It is clear that forms of heat generation other than by means of a burner are also possible. Where mention has been made of a suction connection, that term includes any connection for removing molten metal for transportation to the circulation means, just as the term pressure connection includes any connection which is suitable for conveying molten metal originating from the circulation means into the melting apparatus.

It will be obvious to the person skilled in the art that the invention and its embodiment can also be applied to a melting apparatus in which melting chamber and burner chamber are combined to form a single chamber provided with a sloping base and in which the circulation means are suitable or used for transporting molten metal from the one region of the melting apparatus to another region, preferably situated higher, of the melting apparatus. As a result of feeding to a more highly situated region, advantages are achieved, such as described above for a melting apparatus having two chambers.

What is claimed is:

1. Melting apparatus for melting a metal, comprising:

a melting chamber (2) which comprises a base, a burner chamber (3), a passage (9) which extends between the melting chamber (2) and the burner chamber (3) and which has an inlet opening (10) on the melting-chamber side and an outlet opening (11) on the burner-chamber side for allowing molten metal to pass from the melting chamber (2) to the burner chamber (3), circulation means (33) suitable for transferring the molten metal to a second or pressure connection (36) of the melting chamber (2) from a first or suction connection (32) of the burner chamber (3), wherein the base (7) of the melting chamber is inclined towards the inlet opening (10) of the passage (9) by a melting-chamber gradient, the base (8) of the burner chamber (3) is inclined with a burner-chamber gradient towards the suction connection, and the base (8) of the burner chamber (3) comprises distribution means to spread the liquid metal, emerging from the outlet opening, over the base (8) of the burner chamber for the purpose of increasing the surface area of said base (8) of the burner chamber (3) covered by liquid metal in a situation in which the level of the liquid level in the melting apparatus is lower than the outflow opening.

2. Melting apparatus according to claim 1, wherein the circulation means (33) comprise an electromagnetic pump.

3. Melting apparatus according to claim 1, wherein the direction in which the melting-chamber gradient is inclined differs essentially from the direction in which the burner-chamber gradient is inclined.

4. Melting apparatus according to claim 3, wherein the direction in which the melting-chamber gradient is inclined is essentially opposite to the direction in which the burner-chamber gradient is inclined.

5. Melting apparatus according to claim 1 wherein characterised in that the melting apparatus is provided with a transport channel which is suitable for conveying molten metal between the pressure connection and the inlet opening of the passage at least in a situation in which the base of the melting chamber is not completely covered with liquid metal.

6. Melting apparatus according to claim 5, wherein the transport channel is bounded by the base of the melting chamber and a wall of the melting chamber in which the inlet opening is situated, which base and wall enclose an acute angle.

7. Method for melting a metal, comprising: melting the metal in an apparatus comprising:

a melting chamber (2) which comprises a base, a burner chamber (3), a passage (9) which extends between the melting chamber (2) and the burner chamber (3) and which has an inlet opening (10) on the melting-chamber side and an outlet opening (11) on the burner-chamber side for allowing molten metal to pass from the melting chamber (2) to the burner chamber (3), circulation means (33) suitable for transferring molten metal to a second or pressure connection (36) of the melting chamber (2) from a first or suction connection (32) of the burner chamber (3), wherein the base (7) of the melting chamber is inclined towards the inlet opening (10) of the passage (9) by a melting-chamber gradient, the base (8) of the burner chamber (3) is inclined with a burner-chamber gradient towards the suction connection, and the base (8) of the burner chamber (3) comprises distribution means to spread the liquid metal, emerging, from the outlet opening, over the base (8) of the burner chamber for the purpose of increasing the surface area of said base covered by liquid metal in a situation in which the level of the liquid level in the melting apparatus is lower than the outflow opening;

passing the molten metal from the melting chamber (2) to the burner chamber (3) through the passage (9); and removing the molten metal from the burner chamber and transporting the molten metal by the circulation means, situated outside the burner chamber and the melting chamber, to the melting chamber, the melting chamber and the burner chamber being hydraulically coupled to one another.

8. Melting apparatus according to claim 2, wherein the direction in which the melting-chamber gradient is inclined differs essentially from the direction in which the burner-chamber gradient is inclined.

9. Melting apparatus according to claim 8, wherein the direction in which the melting-chamber gradient is inclined is essentially opposite to the direction in which the burner-chamber gradient is inclined.

10. Melting apparatus according to claim 2, wherein the melting apparatus is provided with a transport channel which is suitable for conveying molten metal between the pressure connection and the inlet opening of the passage at least in a situation in which the base of the melting chamber is not completely covered with liquid metal.

11. Melting apparatus according to claim 10, wherein the transport channel is bounded by the base of the melting chamber and a wall of the melting chamber in which the inlet opening is situated, which base and wall enclose an acute angle.

12. Method according to claim 7, wherein the circulation means (33) comprise an electromagnetic pump and the molten metal being transferred from the first or suction connection (32) of the burner chamber (3) to the second or pressure connection (36) of the melting chamber (2) passes through the electromagnetic pump.

13. Method according to claim 7, wherein the molten metal travels along the melting chamber base at the melting-chamber gradient which is inclined in a direction which differs essentially from the direction in which the burner-chamber gradient is inclined.

14. Method according to claim 13, wherein the molten metal travels along the melting chamber base at the melting-chamber gradient which is inclined in a direction which is essentially opposite to the direction in which the burner-chamber gradient is inclined.

15. Method according to claim 7, wherein the molten metal is conveyed between the pressure connection and the inlet opening of the passage through a transport channel when the base of the melting chamber is not completely covered with liquid metal.

16. Method according to claim 15, wherein the molten metal is conveyed between the pressure connection and the inlet opening through the transport channel which is bounded by the base of the melting chamber and a wall of the melting chamber in which the inlet opening is situated, which base and wall enclose an acute angle.

17. Method according to claim 12, wherein the molten metal travels along the melting-chamber gradient is inclined differs essentially from the direction in which the burner-chamber gradient is inclined.

18. Method according to claim 17, wherein the molten metal travels along the melting chamber base at the melting-chamber gradient which is inclined in a direction which is essentially opposite to the direction in which the burner-chamber gradient is inclined.

19. Method according to claim 12, wherein the molten metal is conveyed between the pressure connection and the inlet opening of the passage through a transport channel when the base of the melting chamber is not completely covered with liquid metal.

20. Method according to claim 19, wherein the molten metal is conveyed between the pressure connection and the inlet opening through the transport channel which is bounded by the base of the melting chamber and a wall of the melting chamber in which the inlet opening is situated which base and wall enclose an acute angle.

21. Method according to claim 7, wherein the molten metal comprises aluminum and is melted.

22. Method according to claim 12, wherein the molten metal comprises aluminum, and is melted.

* * * * *